United States Patent [19]

Silvestri, Jr. et al.

[11] Patent Number: 4,850,793

[45] Date of Patent: Jul. 25, 1989

[54] STEAM CHEST MODIFICATIONS FOR IMPROVED TURBINE OPERATIONS

[75] Inventors: George J. Silvestri, Jr., Winter Park; Scott W. Kendall, Orlando, both of Fla.

[73] Assignee: Westinghouse Electric Corp., Pittsburgh, Pa.

[21] Appl. No.: 107,735

[22] Filed: Oct. 13, 1987

[51] Int. Cl.[4] ..... F01D 17/18

[52] U.S. Cl. ..... 415/38; 415/44; 415/155; 137/862

[58] Field of Search ..... 415/38, 40, 44, 45, 415/150, 151, 155; 137/862, 883; 60/644.1

[56] References Cited

U.S. PATENT DOCUMENTS

| | | | |
|---|---|---|---|
| 1,118,419 | 11/1914 | Hohn | 415/40 X |
| 1,197,283 | 9/1916 | Gibson | 415/44 X |
| 1,997,456 | 4/1935 | Dickinson et al. | 415/40 |
| 2,745,422 | 5/1956 | Wilson | 415/38 |
| 3,310,069 | 3/1967 | Hoffman | 137/862 X |
| 4,036,020 | 7/1977 | Bagley | 60/644.1 |
| 4,053,786 | 10/1977 | Jones et al. | 290/52 |
| 4,253,308 | 3/1981 | Eggenberger et al. | 60/664 |
| 4,325,670 | 4/1982 | Silvestri, Jr. | 415/1 |
| 4,604,028 | 8/1986 | Yeaple et al. | 415/44 X |

FOREIGN PATENT DOCUMENTS

| | | | |
|---|---|---|---|
| 366826 | 1/1923 | Fed. Rep. of Germany | 415/155 |
| 485669 | 1/1918 | France | 415/44 |

*Primary Examiner*—Robert E. Garrett
*Assistant Examiner*—Joseph M. Pitko

[57] ABSTRACT

Existing steam chests having a plurality of valves which are incapable of operation by individual high pressure valve actuators may be modified to provide apparatus for transferring operation of a steam turbine at less than a full load betweeen a full-arc admission mode and a partial-arc admission mode. For those steam chests of the internal bar lift type, the outboard valves are disconnected from the bar and coupled directly to respective servomotors. As such, the pre-existing servomotor utilized to lift the internal bar, as well as the additional servomotors for the outboard valves, are operatively connected to a conventional control means. In those steam chests of the external bar lift type, an additional servomotor is coupled through an actuator rod to the pre-existing pivot point of the external bar, and is thereafter controlled by conventional means for interactively activating the pre-existing servomotor and the additional servomotor.

26 Claims, 4 Drawing Sheets

STEAM CHEST MODIFICATIONS FOR IMPROVED TURBINE OPERATIONS

BACKGROUND OF THE INVENTION

This invention relates generally to steam turbines, and more particularly to improved apparatus for controlling a flow of steam to such turbines.

In a steam turbine generator system, the turbine is normally maintained at a constant speed and steam flow is varied to adjust the torque required to meet the electrical load imposed on the generator. This type of control is provided by a main control system which varies the flow of steam to the high-pressure turbine, and in some instances to the low-pressure turbine, to meet the load demand. The main control system is designed to accommodate for normal changes in load demand and to smoothly adjust the turbine operating conditions to the new demand. However, if the electrical load is suddenly lost or reduced significantly, a commensurate reduction must be made in the flow of steam through the turbine or the turbine will overspeed, possibly causing turbine damage. The main control system does not possess sufficiently rapid response characteristics to accommodate for such sharp variations in low demand, especially in high power to inertia ratio turbine systems.

As is well known, large steam turbines generally include multiple nozzle chambers through which steam is directed into the turbine nozzle through turbine blades which are rotated thereby. Nozzle chamber activation (i.e., steam admission thereinto) is regulated by valves which open to provide steam flow from steam supply conduits into the nozzle chambers, and close to obstruct steam flow thereinto. A valve point is defined as a state of steam admission in which each valve is in the completely open, unobstructing configuration. As is well known, in actual operations of conventional steam chests the valve point does not occur at a full open or full closed position, but occurs just prior to the actuation of the next valve. It can be shown that maximum turbine efficiency can be obtained from the use of an infinite number of valve points which, in turn, requires an infinite number of valves.

Of course, a finite number of valves must be used on steam turbines with that number of valves being dictated by compromises between improved turbine performance and increasing capital cost for increasing numbers of valves. One or more valves control the flow of steam into each nozzle chamber. Nozzle chamber activation refers to the process of increasing steam flow into the nozzle chambers from the time steam flow threinto is initiated until the maximum steam flow thereinto (i.e., completely activated) is achieved. Deactivation refers to the process of decreasing steam flow into the nozzle chambers. When multiple valves are used to regulate steam flow into a single nozzle chamber, those valves typically modulate together. Since such valves modulate together, turbine efficiency is actually a maximum when the nozzle chambers are each in the completely activated or completely deactivated. Heretofore, the nozzle chambers were activated in a predetermined sequence such that once the nozzle chamber was activated during increasing load on the turbine, it was not deactivated until the load on the turbine decreased. One of the few restraints on nozzle chamber activation sequence was that single shock operation was preferred over double or multiple shock operation. That is, it is usually preferable practice to activate nozzle chambers such that newly activated nozzle chamber (i.e., after minimum admission) is circumferentially adjacent at least one previously activated nozzle chamber. One illustrative method for admitting steam into a steam turbine is disclosed in U.S. Pat. No. 4,325,670, issued Apr. 20, 1982 to George J. Silvestri, Jr., assigned to the assignee of the present invention, and incorporated herein by reference.

One recurring problem encountered by such turbines, however, is known in the art as low cycle thermal fatigue. With many older turbines being relegated to cycling operations such as load following and on-off or "two shifting" operation, the potential for low cycle thermal fatigue is increased significantly. The problem of low cycle thermal fatigue can be minimized in newer turbines by placing individual actuators for each valve in the steam chests of the turbines. Older steam chests, such as those used in the mechanical hydraulic (MH), analog as those used in the mechanical hydraulic (MH), analog electric hydraulic (AEH) and digital electric hydraulic (DEH) turbine control systems, may not have individual valve actuators, nor may they have sufficient s pace between the valves to accommodate individual valve actuators. This is especially true in those cases where the actuator incorporates springs necessary to insure rapid closure of the valves during turbine trips. One solution to such problems would be the wholesale but costly replacement of the steam chests. It would, therefore, be desirable to modify existing steam chests to minimize low cycle thermal fatigue caused by cycling operations.

It is well known that low load and part load operation of steam turbines with sliding throttle pressure not only reduces low cycle thermal fatigue, but also improves the heat rate. In particular, operation in a hybrid (i.e., a combined mode of operation with constant pressure-sequential valve and sliding throttle) results in a maximum heat rate benefit while reducing the change in first stage exit temperature, thereby reducing low cycle thermal fatigue. With hybrid operation, a partial-arc admission turbine is operated in the upper load range by activating individual valves to effect load changes along with constant throttle pressure operation. As load is reduced, when a particular valve point is reached, valve position is held constnat and throttle pressure is varied or slid to achieve further load reductions. On units with essentially 100% admission at maximum load, hybrid operation with a 50% minimum first stage admission achieves the heat rate benefit of constant throttle pressure operation. Additionally, when valve loop losses are considered, hybrid operation has superior thermal performance to partial-arc designs operating with constant throttle pressure and having admission points below 50% at loads below from 65 to 70% of a maximum value. For units with considerably less than 100% admission at maximum load, optimum hybrid operation is achieved at the valve point where half of the valves are wide open and half are closed Therefore, it would be desirable to provide apparatus for a valving sequence on turbines having steam chests without individual actuators in such a manner that the valves correspond to 50% first stage admission (or half of the total number of valves) all open simultaneously, thereby achieving optimum hybrid operation.

However, start up procedures that increase rotor life require a different operating mode than hybrid operation. Full-arc admission during turbine roll, for example, has proven beneficial for rotor warmup and more uniform heating as well as reducing the steam-to-metal temperature mismatches that increase low cycle thermal fatigue. It has also been noted that maintaining full-arc admission operation beyond synchronization of the turbine up to some level of load can be beneficial. Full-arc admission operation at part load, however, cannot be achieved on turbines having steam chests without individual valve actuators for which the valves are set for minimum first stage admissions below 100%. It has also been noted that an expected increase in rotor life is achievable when the transfer from full to partial-arc is made during the loading cycle as compared to full-arc admission operation all the way to full load. It is, therefore, apparent that a steam chest having the capability of valve transfer from full to partial-arc admission and vice versa would be extremely desirable for turbines utilized in cycling operations.

SUMMARY OF THE INVENTION

Accordingly, it is a general object of the present invention to provide a steam chest capable of operating with full-arc or maximum admission, and still allow a transfer from full (or maximum) to partial-arc (or a lower level) admission and vice versa. More specifically, it is an object of the present invention to provide a steam chest having such capability in conjunction with sliding throtle pressure operation for turbines utilized in cycling operations. It should be noted at this juncture that the term "full-arc" admission is meant to encompass "maximum" admission on turbines which do not have 100% admission at maximum load. Likewise, on turbines with less than 100% admissison at maximum load, "partial-arc" admission is meant to encompass a lower or lesser arc of admission than that corresponding to maximum load.

It is another object of the present invention to provide apparatus for existing steam chests which would enable them to achieve the above stated capabilities without requiring individual valve actuators.

Still another object of the present is to provide such apparatus which is capable of improving the heat rate of the turbine, as well as increasing its rotor life.

Briefly, these and other objects of the present invention are accomplished in a conventional steam turbine having a casing including inlet means for receiving a flow of steam by steam chest means for regulating the flow of steam through the inlet means, the steam chest means comprising a plurality of valves each of which are set for a minimum admission of the flow of steam to the inlet means below 100%, bar lift means for actuating at least one pair of the valves, high pressure means for actuating remaining ones of the plurality of valves, and means for controlling the bar lift means and high pressure means whereby the turbine is adapted to be transferred between a full-arc (or maximum) admission mode and a partial-arc (lower level) admission mode. In steam chests of the internal bar lift type, the bar is shortened or removed such that only the two innermost valves of a 4-valve steamchest are still actuated by the bar lift means, while the two outboard valves at each end of the steam chest are replaced with ones having individual high pressure actuators. For those steam chests of the end bar or external bar lift type, the pivot on the fixed end of the bar would be replaced with another servomotor such that the actuator rod of the new servomotor would incorporate the pivot for the external bar. By a combination of lifts of the existing servomotor and the new servomotor, it would be possible to operate at full-arc admission at start up and to make the transition from full (or maximum) to partial-arc (and vice versa) at whatever level of load is desired and whatever value of partial-arc admission is consistent with first stage requirements and optimum loading conditions.

These and other objects, advantages, and novel features according to the present invention will become more apparent from the following detailed description of the invention when considered in conjunction with the accompanying drawings wherein:

DETAILED DESCRIPTION OF THE INVENTION

Figure 1:
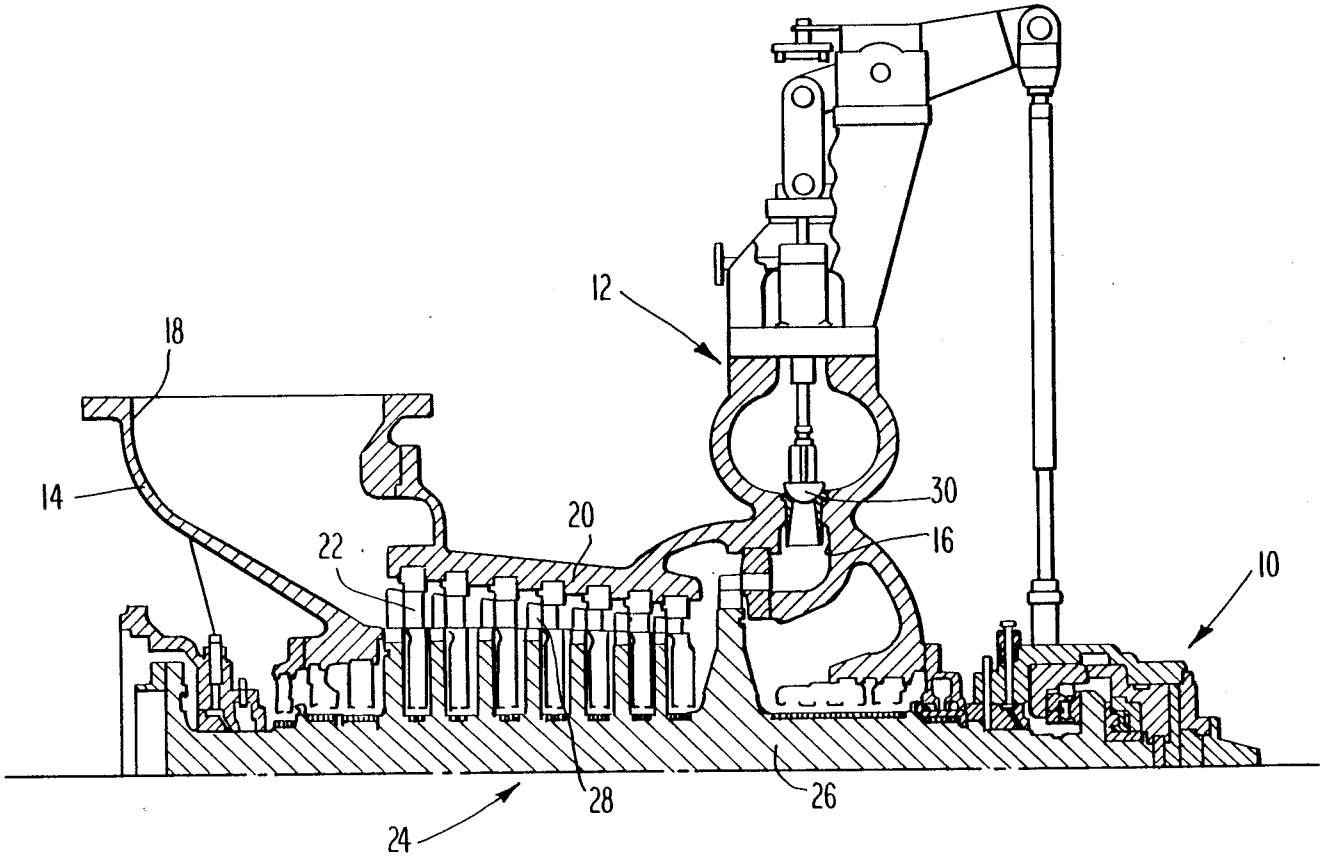
Fig. 1 PRIOR ART
FIG. 1 is a half-sectional view of a steam turbine utilizing a prior art steam chest.

Referring now to the drawings, wherein like characters designate like or corresponding parts throughout the several views, there is shown in FIG. 1 a half-sectional view of a steam turbine 10 which utilizes a conventional steam chest 12 for controlling the flow of steam from a source such as a fossil-fired boiler or a nuclear reactor (not shown). As is conventional, the steam turbine 10 includes a casing 14 having inlet means 16 for receiving the flow of steam as well as means for exhausting 18 the flow of steam. Stator means 20, including a stationary set of blades 22 for directing the flow of steam are mounted within the casing 14, while rotor means 24 including a shaft 26 having a rotatable set of blades 28 mounted thereon adjacent to the stationary set of blades 22 receive the flow of steam directed by the stator means 20, and transmit the work performed thereby to a load (not shown) through the shaft 26. In a well known manner, the steam chest 12 is used to regulate the flow of steam through the inlet means 16.

Figure 2:
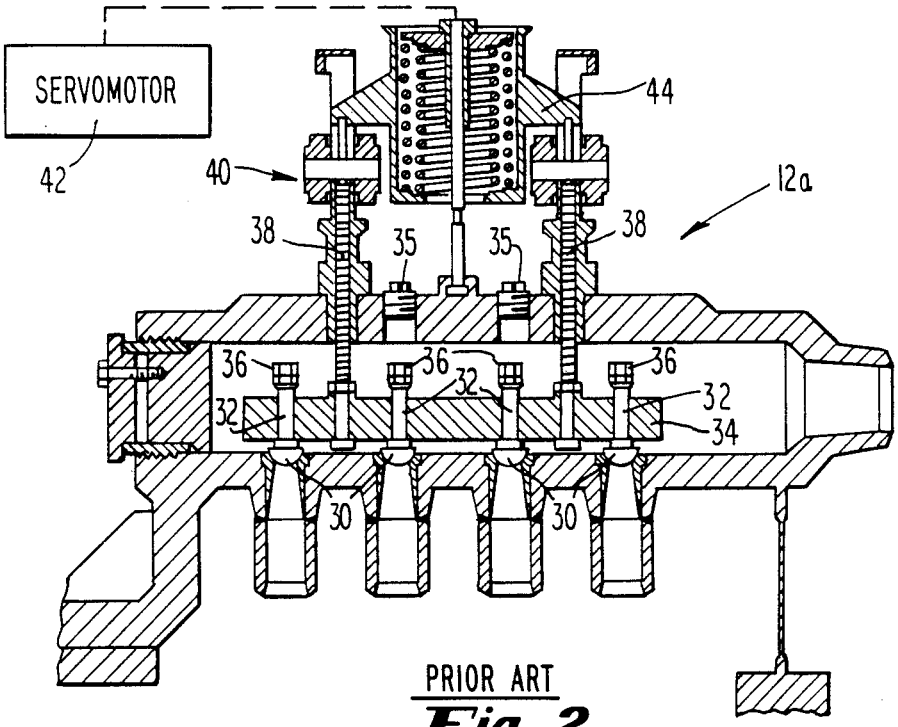
PRIOR ART Fig. 2
FIG. 2 illustrates a prior art steam chest of the internal bar lift type.

As is shown in greater detail in FIG. 2, the steam chest means 12 may be comprised of a steam chest **12*a* referred to in the prior art as an internal bar lift steam chest. Such steam chests 12*a* typically include a plurality of valves 30 attached by respective valve stems 32 to a bar 34 located internally of the steam chest 12*a*. Each of the valves 30 may further comprise a height adjustment nut 36, accessible through threaded plugs 35, for varying the point at which each respective valve 30 is opened or closed. The bar 34 serves to actuate the valves 30 through a pair of lift rods 38 connected to a lifting yoke 40 operable by a conventional servomotor 42 and pressure balance cylinder 44**.

Figure 3:
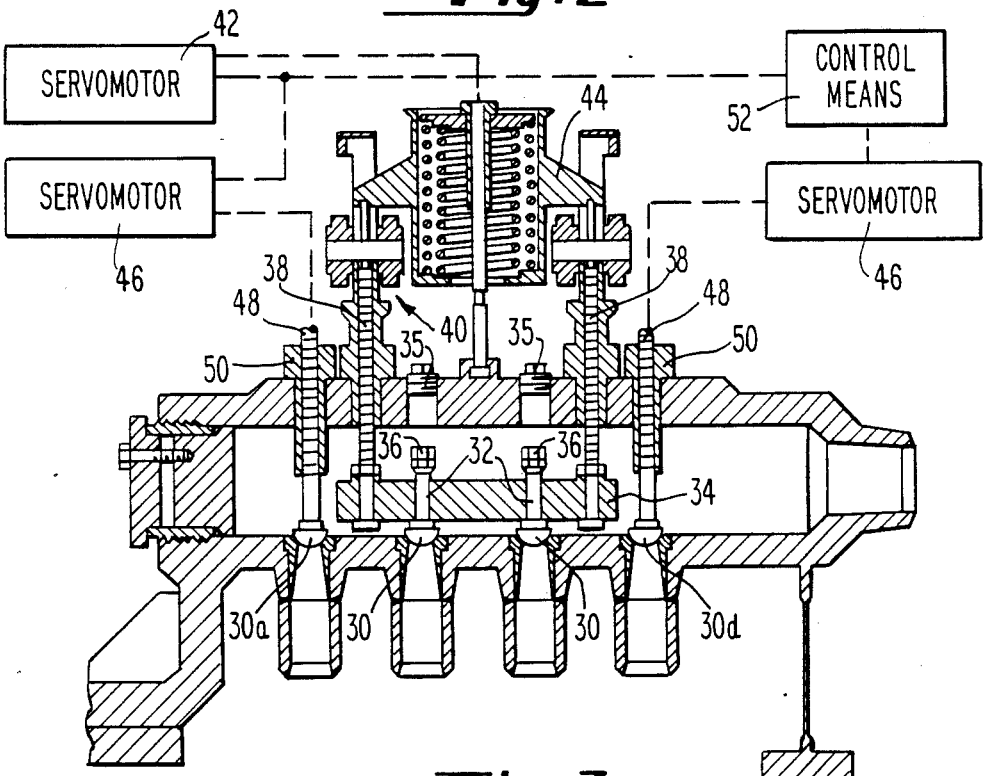
FIG. 3 is a sectional view of the steam chest shown in FIG. 2 as modified in accordance with one embodiment of the present invention.

As is evident from FIG. 2, adaptation of the steam chest **12*a* for maximized efficiency through installation of individual high pressure valve actuators, such as those produced by the Utility Power Corporation of Bradenton, Fla., is hampered because of the size of the closure springs used in such actuators when compared to the intervalve spacing of the steam chest 12***a*. Moreover, some individual high pressure valve actuators such as those manufactured by the assignee of present invention require their supply pressure to be developed by an external pump thereby further congesting their installation. The "unitized" design produced by the Utility Power Corporation, on the other hand, incorporate the fluid supply and pump within the actuator housing. Referring now to FIG. 3, there is shown one means for maximizing the efficiency of a steam turbine 10 adapted to operate at less than a full load by providing apparatus for transferring between a full-arc admission mode and a partial-arc admission mode. The outboard valves 30*a* and 30*d* are disconnected from the bar 34 and provided with individual high-pressure valve actuators 46 of the type described herein above. Each valve 30*a* and 30*d* is thereafter coupled to its respective actuator 46 by a lift rod 48 guided by a lift rod bushing 50. In order to minimize the height of the lift rod bushing 50, thereby minimizing interference with existing servomotor means comprised of the lifting yoke 40, servomotor 42, and pressure balance cylinder 44, the lift rod bushing 50 for valves 30*a* and 30*d* may be extended within the steam chest 12*a* since it would not produce anymore flow restriction than the pre-existing valve stems 32, their height adjustment nuts 36, and that portion of the bar 34 necessary to operate the outboard valves 30*a* and 30*d*.

The bar 34, in order to provide space for the lift rods 48 and lift rod bushings 50, is shortened as shown in FIG. 3. If required, the pre-existing lift rods 38 may be moved inboard to accommodate such shortening of the bar 34. Thereafter, the servomotors of the high pressure actuators 46, as well as the pre-existing servomotor 42 are coupled to conventional means 52 for controlling the servomotors such that the steam turbine 10 may be operated with full-arc (i.e., maximum arc) admission, and still be capable to be transferred from a full to a partial-arc admission mode and vice versa.

Figure 3A:
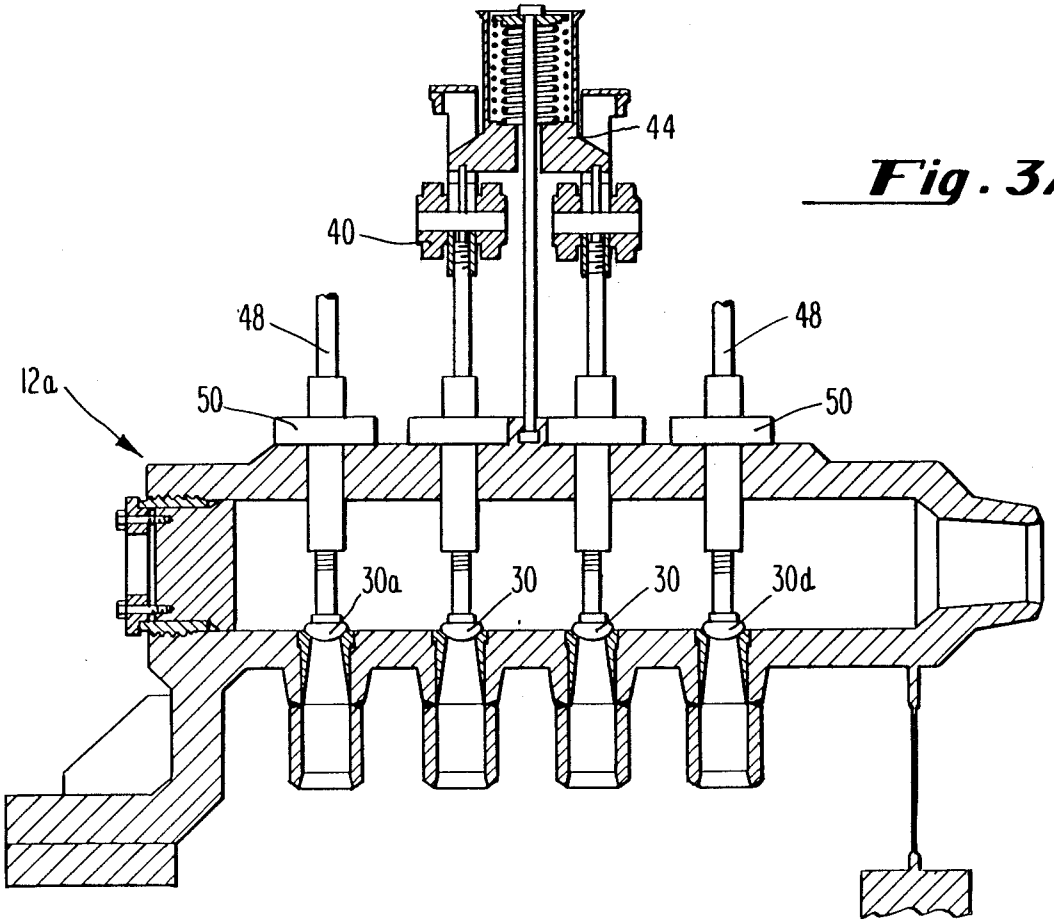
FIG. 3A is a sectional view of the steamchest shown in FIG. 2 as modified in accordance with a second embodiment of the present invention.

A second embodiment of the present invention is shown in FIG. 3A. As shown therein, the steam chest 12*a* has its internal bar completely removed, and the outboard valves 30*a* and 30*d* are coupled to individual high pressure valve actuators (not shown) via lift rods 48 guided by bushings 50 in the same manner as shown and described with respect to the apparatus of FIG. 3. The two innermost valves are modified by coupling them to their own lift rods 48, and bushings 50, thereby replacing their valve stems. In order to provide greater space for the actuators of the outboard valves 30*a* and 30*d*, the bushings 50 for the innermost valves may be adapted to be threaded within the access holes previously used for the plugs 35 shown in FIGS. 2 and 3. The remaining bar lift means comprised of the lifting yoke 40, servomotor (not shown) and pressure balance cylinder 44 is modified by reducing the distance between the arms of the yoke 40 to accommodate the shorter distance between lift rods 48 of the innermost valves. By removal of the bar completely, there will be an obviously lower flow obstruction within the steam chest 12*a*, as well as less pressure drop. Moreover, there will be less valve vibration since the valves will no longer hang loose from the bar.

Figure 4:
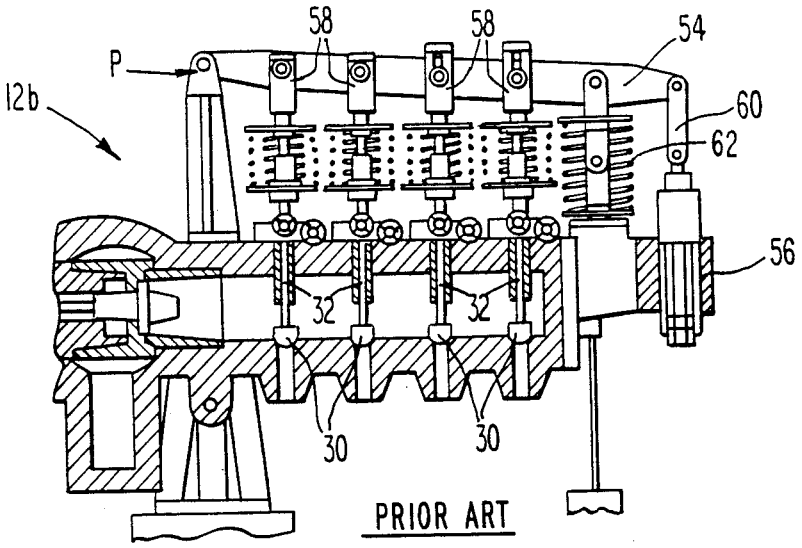
FIG. 4 illustrates a steam chest of the end bar or external bar lift type.
Figure 5:
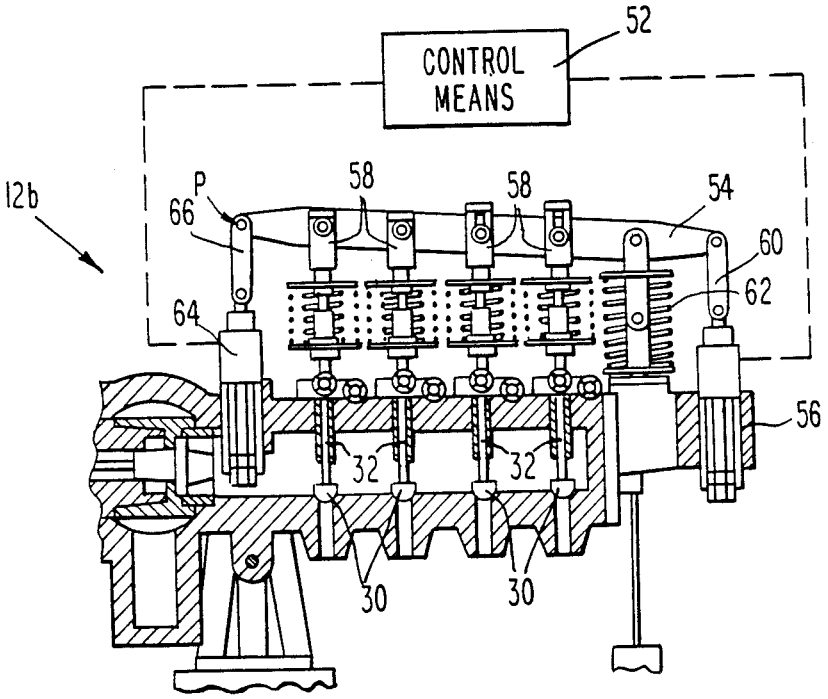
FIG. 5 is a sectional view of the steam chest shown in FIG. 4 as modified in accordance with a third embodiment of the present invention.

Referring now to FIGS. 4 and 5, a third (i.e., lesser arc) embodiment of the present invention is shown. A conventional end bar or external bar lift type steam chest 12*b* (FIG. 4) typically comprises three or four valves arranged linearly within the steam chest 12*b* and operable through their valve stems 32 by a bar 54 situated externally from the steam chest 12*b*, and actuated by a servomotor 56. Each of the valve stems 32 are pivotally coupled to the bar 54 through a linkage 58. At the end of the bar 54 opposite the servomotor 56, the bar 54 is pivoted about a point P which is fixed to the steam chest 12*b*. Upon actuation of the servomotor 56, an actuator rod 60 coupled to the other end of the bar 54 is moved reciprocably upward forcing the bar 54 to pivot about the point P, and thereby opening the valves 30. A closure spring 62 is conventionally utilized to provide a positive force for closing the valves 30 upon tripping of the steam turbine 10.

In order to adapt the external bar lift type steam chest 12*b* in accordance with a third embodiment of the present invention, an additional servomotor 64 is installed in close proximity to the steam chest 12*b* and coupled to the bar 54 through an actuator rod 66 pivotally attached to the pivot point P. That is since both actuator rods 60 and 66 are pivotally coupled to the bar 54, and each valve stem 32 is pivotally coupled to the bar 54 through its re spective linkage 58, as the actuator rods 60 and 66 are moved reciprocably upward and downward by their respective servomotor 56 or 64, the valve stems 32 will be pulled upward or downward depending upon the relative orientation of the bar 54 as determined by the relative heights of the actuator rods 60 and 66. As in the case of the apparatus described with reference to FIGS. 3 and 3A, both servomotors 56 and 64 are operatively connected to the conventional control means 52 such that the valves are operated upon interaction of the servomotors 56 and 64.

While particular embodiments of the invention have been shown and described, various modification are within the true spirit and scope of the invention. The appended claims are, therefore, intended to cover such modifications.

I claim:

1. In a steam turbine adapted to operate at less than a full load, apparatus for transferring between a fullarc admission mode and a partial-arc admission mode, comprising:

a source of motive steam;

a steam chest receiving said motive steam from said source, said steam chest including a plurality of valves each of which are set for a minimum admission of said motive steam into the turbine below 100%;

bar lift means for actuating at least one pair of said valves;

high pressure means, independent of said bar lift means, for actuating remaining ones of said plurality of valves; and means for controlling said bar lift means and said high pressure means.

2. The apparatus according to claim 1, wherein said source comprises a nuclear reactor.

3. The apparatus according to claim 1, wherein said plurality of valves comprises four valves arranged within said steam chest in a single line.

4. The apparatus according to claim 3, wherein said bar lift means comprises an internal bar lift means.

5. The apparatus according to claim 4, wherein said internal bar lift means comprises;

first servomotor means;

a lifting yoke connected to said first servomotor means;

a bar coupled to said at least tone pair of said valves; and a pair of lift rods coupled between said lifting yoke and said bar.

6. The apparatus according to claim 4, wherein said high pressure means comprises:

an additional servomotor means for each said remaining valve;

a lift rod connected between each said additional servomotor means and its respective valve, said lift rod opening and closing said valve upon actuation by said servomotor means; and spring means coupled to said valve for providing a positive closure force thereto.

7. The apparatus according to claim 3, wherein said bar lift means comprises an external bar lift means.

8. The apparatus according to claim 7, wherein said external bar lift means comprises:

first servomotor means;

a bar pivotably coupled at one end thereof to said first servomotor means, said bar also adapted to be pivoted about a point proximate to its other end; and lift rod means for opening and closing said valves, said lift rod means connected to each said valve and pivotably coupled to said bar.

9. The apparatus according to claim 8, wherein said high pressure means comprises second servomotor means coupled to said bar at said point.

10. The apparatus according to claim 1, wherein said plurality of valves comprises three valves arranged within said steam chest in a single line.

11. The apparatus according to claim 1, wherein said plurality of valves are arranged within said steam chest in a single line.

12. The apparatus according to claim 11, wherein said bar lift means comprises:

first servomotor means; and a lifting yoke connected between said first servomotor means and at least one of said plurality of valves, aid at least one valve being inboard of an outboard pair of said valves and coupled to said lifting yoke by a lift rod guided by a bushing attached to said steam chest.

13. A steam turbine, comprising:

a casing including inlet means for receiving a flow of steam and means for exhausting said flow of steam;

stator means mounted within said casing, said stator means including a stationary set of blades for directing said flow of steam;

rotor means including a shaft having a rotatable set of blades mounted thereon adjacent to said stationary set of blades for receiving said flow of steam directed by said stator means and for transmitting work performed thereby to a load through said shaft; and steam chest means for regulating said flow of steam through said inlet means, said steam chest means comprising a plurality of valves each of which are set for a minimum admission of said flow of steam to said inlet means below 100%, bar lift means for actuating at least one pair of said valves, high pressure means, independent of said bar lift means, for actuating remaining ones of said plurality of valves, and means for controlling said bar lift means and said high pressure means whereby the turbine is adapted to be transferred between a full-arc admission mode and a partial-arc admission mode.

14. The turbine according to claim 13, wherein said plurality of valves are linearly arranged within said steam chest means.

15. The turbine according to claim 14, wherein said bar lift means comprises:

a bar coupled to said at least one pair of said valves, said bar disposed internally within said steam chest means; and first servomotor means for lifting said bar, said first servomotor means including an actuator rod coupled to a lifting yoke having attached thereto a pair of lift rods coupled through said steam chest means to said bar.

16. The turbine according to claim 15, wherein said first servomotor means further comprises a pressure balance cylinder coupled to said lifting yoke.

17. The turbine according to claim 15, wherein said high pressure means for actuating remaining ones of said plurality of valves comprises:

an additional servomotor for each said remaining valve; and a lift rod connected between each said additional servomotor and its respective valve, wherein said lift rod opens and closes said valve upon actuation of said additional servomotor.

18. The turbine according to claim 14, wherein said bar lift means comprises:

first servomotor means mounted external to said steam chest means;

a bar pivotably coupled at one end thereof to said first servomotor means, said bar also mounted external to said steam chest means and adapted to be pivoted about a point proximate to the other end of said bar; and lift rod means for opening and closing said valves, said lift rod means connected to each said valve and pivotably coupled to said bar.

19. The turbine according to claim 18, wherein said high pressure means comprises:

second servomotor means mounted external to said steam chest means;

an actuator rod reciprocably actuated by said second servomotor means and pivotably coupled to said bar at said point; and spring means coiled about said actuator rod for providing a positive closure force to said valve.

20. An improved steam chest having a plurality of valves adapted to be opening and closed for control of a flow of steam therethrough, wherein the improvement comprises:

bar lift means including first servomotor means for actuating at least an adjacent pair of the valves;

high pressure means for actuating remaining ones of the plurality of valves; and means for controlling said bar lift means and said high pressure means.

21. The improvement according to claim 20, wherein said high pressure means comprises:

an additional servomotor means for each said remaining valve; and a lift rod connected between each said additional servomotor means and its respective valve, wherein said lift rod opens and closes said valve upon actuation of said additional servomotor means by said controlling means.

22. The improvement according to claim 21, wherein said high pressure means comprises:

second servomotor means including an actuator rod coupled to said bar lift means for cooperatively actuating each of the plurality of valves; and spring means coiled about said actuator rod for providing a positive closure force to said valves.

23. In a steam turbine adapted to operate at less than a full load, apparatus for transferring between a full-arc admission mode and a partial-arc admission mode, comprising:

a source of motive steam;

a steam chest receiving said motive steam from said source, said steam chest including a plurality of valves each of which are set for a minimum admission of said motive steam into the turbine below 100%, wherein said plurality of valves comprises four valves arranged within said steam chest in a single line;

bar lift means for actuating at least one pair of said valves, wherein said bar lift means comprises an internal bar lift including first servomotor means, a lifting yoke connected to said first servomotor means, a bar coupled to said at least one pair of said valves, and a pair of lift rods coupled between said lifting yoke and said bar;

high pressure means for actuating remaining ones of said plurality of valves; and means for controlling said bar lift means and said high pressure means.

24. In a steam turbine adapted to operate at less than a full load, apparatus for transferring between a full-arc admission mode and a partial-arc admission mode, comprising:

a source of motive steam;

a steam chest receiving said motive steam from said source, said steam chest including a plurality of valves each of which are set for a minimum admission of said motive steam into the turbine below 100%, wherein said plurality of valves are arranged within said steam chest in a single line;

bar lift means for actuating at least one pair of said valves, wherein said bar lift means comprises first servomotor means, and a lifting yoke connected between said first servomotor means and at least one of said plurality of valves, said at least one valve being inboard of an outboard pair of said valves and coupled to said lifting yoke by a lift rod guided by a bushing attached to said steam chest;

high pressure means for actuating remaining ones of said plurality of valves; and means for controlling said bar lift means and said high pressure means.

25. The apparatus according to claim 24, wherein said high pressure means comprises:

an additional servomotor means for both said outboard valves;

a lift rod connected between each said additional servomotor means and its respective valve, said lift rod opening and closing said valve upon actuation by said servomotor means; and spring means coupled to said valve for providing a positive closure force thereto.

26. A steam turbine, comprising:

a casing including inlet means for receiving a flow of steam and means for exhausting said flow of steam;

stator means mounted within said casing, said stator means including a stationary set of blades for directing said flow of steam;

rotor means including a shaft having a rotatable set of blades mounted thereon adjacent to said stationary set of blades for receiving said flow of steam directed by said stator means and for transmitting work performed thereby to a load through said shaft; and steam chest means for regulating said flow of steam through said inlet means, said steam chest means comprising a plurality of valves each of which are set for a minimum admission of said flow of steam to said inlet means below 100%, wherein said plurality of valves are linearly arranged within said steam chest means, bar lift means for actuating at least one pair of said valves, wherein said bar lift means comprises a bar coupled to said at least one pair of said valves, said bar disposed internally within said steam chest means, and first servomotor means for lifting said bar, said first servomotor means including an actuator rod coupled to a lifting yoke having attached thereto a pair of lift rods coupled through said steam chest means to said bar, high pressure means for actuating remaining ones of said plurality of valves, and means for controlling said bar lift means and said high pressure means whereby the turbine is adapted to be transferred between a full-arc admission mode and a partial-arc admission mode.

* * * * *